US007347757B1

(12) United States Patent
Lanthier

(10) Patent No.: US 7,347,757 B1
(45) Date of Patent: Mar. 25, 2008

(54) RESCUE APPARATUS AND METHOD

(76) Inventor: Ronald E. Lanthier, 15039 Tinker St., Houston, TX (US) 77084

( * ) Notice: Subject to any disclaimer, the term of this patent is extended or adjusted under 35 U.S.C. 154(b) by 505 days.

(21) Appl. No.: 10/986,536

(22) Filed: Nov. 12, 2004

(51) Int. Cl.
*B63C 9/08* (2006.01)
*B63C 9/00* (2006.01)
*B63C 9/15* (2006.01)

(52) U.S. Cl. ..... 441/122; 441/80; 441/90; 441/92

(58) Field of Classification Search ..... 441/80–85, 441/88, 120–124, 90–93, 107, 98; 182/137, 182/3, 6; 601/151, 152; 602/13; 606/202
See application file for complete search history.

(56) References Cited

U.S. PATENT DOCUMENTS 149,513 A 4/1874 Ormsbee
1,611,427 A 12/1926 Evans
4,694,931 A * 9/1987 Sibertin-Blanc et al. ..... 182/3
D357,722 S 4/1995 Fireman
6,186,967 B1 2/2001 Messina
6,533,626 B2 3/2003 Pons
6,568,976 B2 5/2003 Anderson et al.
6,679,743 B1 1/2004 Gerber
6,926,570 B1 * 8/2005 Cortez et al. ..... 441/122
2004/0202805 A1 * 10/2004 Chroman ..... 428/34.1

* cited by examiner

*Primary Examiner*—Lars A. Olson
*Assistant Examiner*—Daniel V. Venne
(74) *Attorney, Agent, or Firm*—Egbert Law Offices

(57) ABSTRACT

A rescue apparatus has a cuff member, an inflatable bladder affixed to the cuff member, a gas line affixed to the cuff member so as to be in fluid communication with the bladder, and a gas canister affixed to the cuff member in valved fluid communication with the bladder. A rope is affixed to and extends along the gas line and has an end affixed to the cuff member. A gas source is connected to the opposite end of the rope for selectively delivering a gas into the bladder through the gas line from a location remote from the cuff member.

10 Claims, 3 Drawing Sheets

RESCUE APPARATUS AND METHOD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to rescue apparatus. More particularly, the present invention relates to rescue apparatus which can be secured to a limb of a person for the purpose of rescuing a person located in a remote location. Additionally, the present invention relates to rescue apparatus that are sufficiently buoyant so as to facilitate the floating of a person on water and for retrieving the person from the water.

BACKGROUND OF THE INVENTION

Persons have long been rescued by safety throws of one kind or another. These include life savers aboard ships, throws with a harness-like vest that can be placed on a person in distress and hauled to safety. Many such safety throws have been proposed in past years. However, each of these types of throws have disadvantages.

These rescue apparatus have a number of common properties. First, such safety throws or rescue apparatus for water rescue must be floatable. In many circumstances, such a rescue apparatus that is thrown to a person in peril in the water cannot easily be grasped by the person if the rescue apparatus should sink. Additionally, such a rescue apparatus would not useful if it does not assist the person in staying afloat. As such, it is highly desirable to provide a new and improved universally favorable rescue apparatus that floats when thrown into water.

Additionally, it is important for rescue apparatus to be in an convenient package for transporting the safety throw when not in use. Prior art life savers aboard ship are hung on the side of the ship with a visible coil of cord attached thereto. To transport the same, both the large coil of cord and the life saver itself must be transported, both of which are extremely bulky. As such, it is important to provide a safety throw that is small in size, light weight, and in a pack that can be easily transported to the person to be rescued.

In cold weather, a person in perilous waters may be suffering from hypothermia. Persons suffering from hypothermia usually cannot grasp any kind of life saving device or cord. Thus, it is highly desirable to provide a rescue apparatus that can be used by persons suffering from hypothermia.

In the past various patents have issued relating to inflatable cuff devices and rescue apparatus. An early patent relating to the subject is found in U.S. Pat. No. 1,611,427, issued on Dec. 21, 1926 to G. Evans. This patent describes a sleeve that aids in natation. This sleeve is suitably inflatable so as to extend around a limb of the person. When secured onto the limb of the person, the air within the inflatable bladder provides buoyancy for the person in the water.

U.S. Design Pat. No. 357,722, issued on Apr. 25, 1995 to A. F. Fireman, describes an arm float with a plurality of inflatable chambers that are elastically connected together so as to wrap around the arm, shoulder, or leg of the person in water.

U.S. Pat. No. 149,513, issued in April 1874 to M. Ormsbee, describes a life preserver that has an annular sack filled with air or with cotton, ground cork, or other buoyant material. The sack is adapted to be worn upon the arm as a sleeve.

U.S. Pat. No. 6,186,967, issued on Feb. 13, 2001 to F. Messina, describes an elevation support for elevating a human limb of a patient to a desired elevation. This support has a body with a longitudinal aperture therethrough and an insertion opening for receiving at least a portion of the limb. The body is shaped to permit concomitant rolling motion along a support surface when the patient exerts a rotational force on the body via the inserted limb while maintaining the limb at the desired elevation.

U.S. Pat. No. 6,533,626, issued on Mar. 18, 2003 to M. Pons, provides an arm on-board device for the rescuing a person from the sea so as to enable a conscious person to rescue himself. A floating trailing end is adapted to be recovered by the person in the sea and serves as a control means to activate the release of the towrope floating element. The floating element is connected to the boat by an end serving as a towrope and having a means serving as a shock absorber. The floating element is provided with towrope attachments. The floating element has a hydrodynamic shape and entirely or partially supports the rescuee with a minimum of resistance to pulling through water.

U.S. Pat. No. 6,568,976, issued on May 27, 2003 to Anderson et al., teaches a flotation cushion with deployable tether. A pocket is formed in the flotation cushion to conform to existing cushion structures. The tether is stored in the pocket in a manner to minimize bulging. With the tether attached at one end to the flotation cushion interior to the pocket, the flotation cushion may be thrown to a person in need of rescue while the user is grasping the tether at its free end. When the person to be rescued grabs the flotation cushion, the tether may be used to retrieve the person and cushion.

U.S. Pat. No. 6,679,743, issued on Jan. 20, 2004 to S. P. Gerber, discloses a safety throw comprising a bag having a bottom with a bottom opening therein. A float is positioned in the bag. A cord ends extends through the float. The float is positioned in the bag between the opposite ends of the cord to partition the bag into a first cord section and a second harness section. The harness is stored in the section adjacent the bag bottom and on the opposite side of the float from the cord section. The bag has a weight with the harness and float in the bag such that the bag may be thrown to a person in peril. The harness may be attached to the person in peril and the person in peril may be pulled to safety by the cord.

It is an object of the present invention to provide a rescue apparatus that can be secured to the limb of a rescuee.

It is another object of the present invention to provide a rescue apparatus whereby the apparatus is suitably buoyant so as to support the person on a body of water.

It is another object of the present invention to provide a rescue apparatus which can remotely secured to a limb of the person so as to facilitate the pulling of the person to safety.

It is still a further object of the present invention to provide a rescue apparatus whereby the rescuee can manually activate the rescue apparatus for buoyancy and for rescue.

It is still another object of the present invention to provide a rescue apparatus which will not injure the limb of the person to which it is secured.

It is still another object of the present invention to provide a rescue apparatus that can be easily stowed, easily deployed and easily applied.

It is another object of the present invention to provide a rescue apparatus which easy to manufacture, relatively inexpensive and easy to use.

These and other objects and advantages of the present invention will become apparent from a reading of the attached specification and appended claims.

BRIEF SUMMARY OF THE INVENTION

The present invention is a rescue apparatus comprising a cuff member, an inflatable bladder affixed to the cuff member, a gas line affixed to the cuff member so as to be in fluid communication with the bladder, and a gas canister affixed to the cuff member in valved fluid communication with the bladder. The gas canister is selectively activatable so as to introduce a gas into the bladder so as to inflate the bladder.

The cuff member includes a panel of material having a length suitable for extending around the human limb. A plurality of straps are affixed to the panel thereacross. The plurality of straps serves to allow for adjustable affixing of the panel onto the human limb. The bladder extends across one surface the panel. The plurality of straps extend across the opposite surface of the panel. A plurality of web members extend across the opposite surface of the panel in a direction transverse the plurality of straps.

A rope is affixed to and extends along the gas line. The rope has an end affixed to the cuff member. The rope includes at least a pair of strands in which the gas line is positioned between the pair of strands. The gas line is covered by a casing material.

A valve is affixed to the cuff member in valved relationship to the bladder. The valve serves to release gas from the bladder when the gas pressure in the bladder exceeds a predetermined amount. This valve is manually activatable so as to release gas from the bladder. The gas canister has a pull line attached thereto. This pull line serves to manually activate the gas canister so as to inflate the bladder. A gas source is connected to the end of the gas line opposite the bladder. The gas source serves to selectively deliver the gas into the bladder through the gas line from a location remote from the cuff member. The present invention is also a method of water rescue of a person comprising the steps of: (1) forming a cuff member having an inflatable bladder thereon or therein; (2) connecting a gas line to the inflatable bladder; (3) delivering the cuff member to the person; (4) affixing the cuff member around a limb of the person; and (5) passing a gas through the gas line into the bladder so as to inflate the bladder in order to exert a compressive force onto the limb.

In the method of the present invention, a rope is formed having the gas line therein or thereon. The rope can be pulled so as to urge the person toward a desired location. The step of affixing the cuff member around the limb of the person includes wrapping the cuff member around the limb and strapping the cuff member into a secure position on the limb. Gas is then introduced into the bladder so as to secure the cuff member onto the limb. Subsequent to rescue, the gas can be released from the bladder and the cuff member removed from the limb of the person.

DETAILED DESCRIPTION OF THE INVENTION

Figure 1:
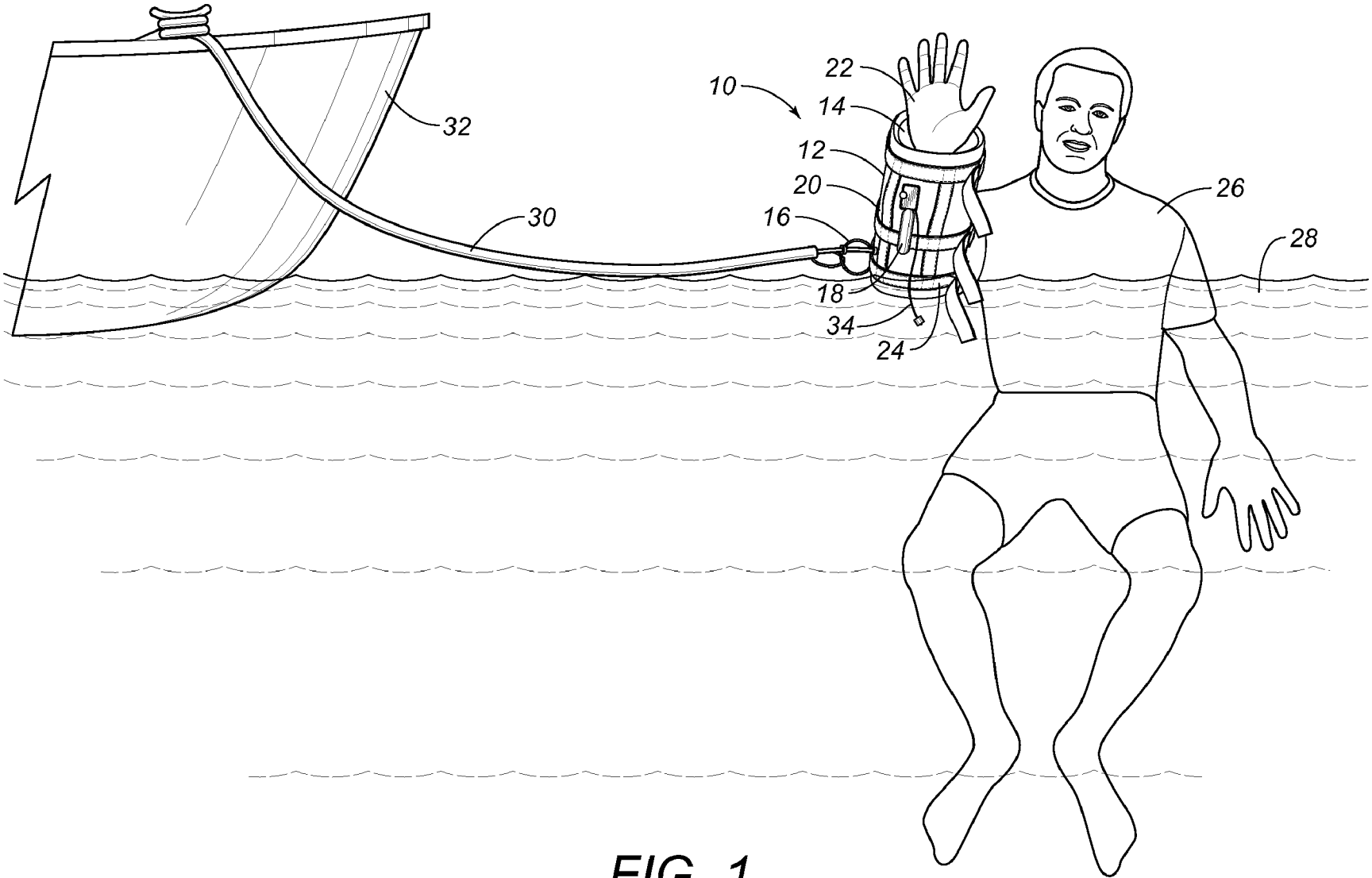
FIG. 1 is an illustration of the application of the rescue apparatus of the present invention onto a person in peril.

Referring to FIG. 1, there is shown the rescue apparatus 10 in accordance with the teachings of the preferred embodiment of the present invention. The rescue apparatus 10 includes a cuff member 12 having an inflatable bladder 14 affixed thereto. A gas line 16 is affixed to the cuff member 12 so as to be in fluid communication with the bladder 14. A gas canister 18 is affixed to the cuff member 12 in valved fluid communication with the bladder 14. The gas canister is selectively activatable so as to introduce a gas into the bladder 14 so as to inflate the bladder 14.

In FIG. 1, it can be seen that the cuff member 12 includes a panel 20 of material having a length suitable for extending around the human limb 22. A plurality of straps 24 are affixed to the panel 20 and extend thereacross. This plurality of straps serve to adjustably affix the panel 20 onto the human limb 22. As will be described hereinafter, the bladder 14 extends across one surface of the panel 20. The plurality of straps 24 extend across an opposite surface of the body.

As can be seen in FIG. 1, the person 26 is floating in a body of water 28. The gas line 16 also includes a suitable rope 30 which extends from the cuff member 12 to a boat 32. The boat 32 has a suitable source of gas pressure therein, such an air pump, a gas canister, or other device, so as to deliver air through the gas line 16 into the bladder 14.

In normal use, when it is desired to rescue the person 26, the cuff member 12 can be tossed to the person 26. The person 26 can then extend the cuff member 12 around his or her limb 22. Once placed upon the limb 22, the person 26 can either manually activate the gas canister 18 by pulling on pull line 34 or can be assisted by person within boat 32 by pumping air through the gas line 16 into the bladder 14. The inflation of the bladder 14 will exert a pressure force onto the limb 22. As a result, the person 26 can be easily pulled to safety by the persons within boat 32 by pulling on the rope 30. Alternatively, the cuff member 12 can be delivered to the person 26 by a person swimming in water 28. If the person 26 is relatively incapacitated, such as a person suffering from hypothermia, the swimmer can simply place the cuff member 12 around the limb 22 (or any of the limb of person 26). The straps 24 can be pulled tight onto the limb 22 so as to secure the cuff member 12 in a proper position. The swimmer can then pull on the pull line 34 so as to activate the canister 18 and inflate the bladder 14 or can send a signal to the persons on boat 32 to deliver air through the gas line 16 into the bladder 14. The inflation of the bladder 14 will provide both a secure compressive force onto the limb 22 of person 26 for the purpose of pulling the person 26 to safety. Also, the inflation of the bladder 14 will provide the person 26 with additional buoyancy so as to support the person 26 at the surface of body of water 28.

Figure 2:
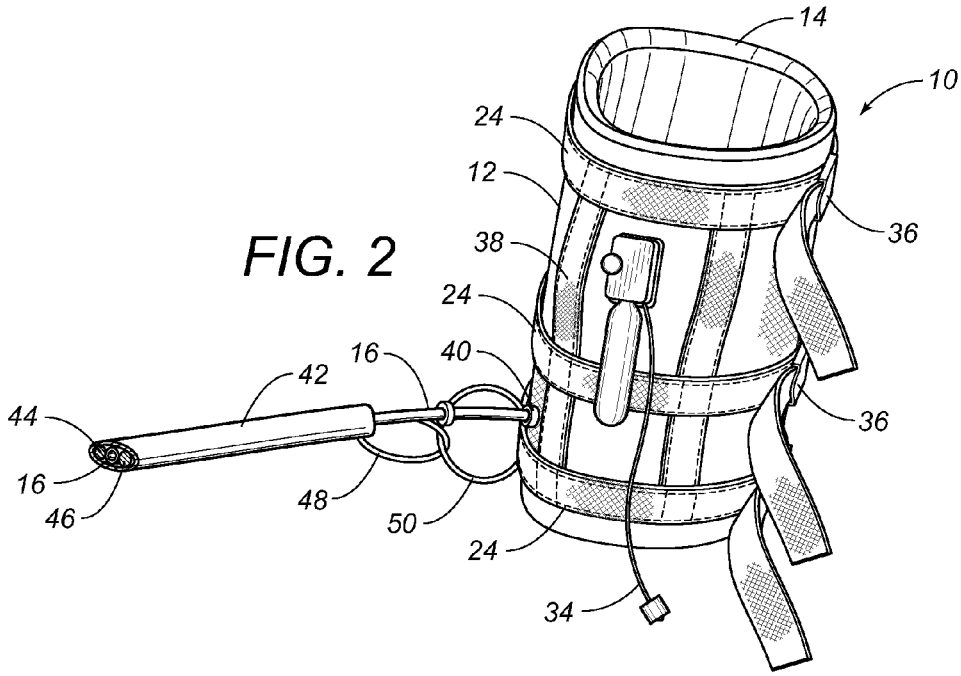
FIG. 2 is a perspective view showing the rescue apparatus of the present invention.

FIG. 2 illustrates the construction of the rescue apparatus 10 of the present invention. Initially, as can be seen, the cuff member 12 can be formed of a panel of material, such as nylon material. The bladder 14 is secured to the inner side of the cuff member 12. Straps 24 will extend across the surface of the cuff member 12 opposite the bladder 14. Buckles 36 can be provided so as to allow the straps 24 to be suitably adjusted so as to increase or decrease the diameter of the cuff member 12. The straps 24 can be formed of any suitable webbing material. Straps 24 can be secured by adhesives, or stitching, to the surface of the cuff member 12. A plurality of web members 38 are also affixed to the surface of the cuff member 12 opposite the bladder 14. Web member 38 will extend transversely to the plurality of straps 24. The combination of the straps 24 and the web members 38 provides the cuff member 12 with great integrity and serves to avoid ripping or tearing of the material associated with cuff member 12.

The gas line 16 is connected to a suitable fitting 40 on the cuff member 12 so as to deliver air, or other gas, to the bladder 14. It can be seen that the gas line 16 extends through the interior of a casing material 42. The casing materials envelopes a pair of strands 44 and 46 within the casing 42. The gas line 16 is interposed between the strands 44 and 46. The combination of the positioning of the strands 44 and 46, along with the casing 42, prevents the gas line 16 from becoming closed as a result of any pulling force applied onto the rope 30. Connectors 48 and 50 serve to rigidly secure the end of the rope 30 onto the cuff member 12.

In FIG. 2, it can be seen that the gas canister 18 is affixed onto the exterior of the cuff member 12 opposite to the bladder 14. Gas canister 18 can contain any suitable inflation gas therein. A pull line 34 is connected to a valve housing 52 associated with gas canister 18. When the pull line 34 is pulled, the valve housing 52 will cause a valve to open. This will allow gas from the canister 18 to be introduced into and fill the bladder 14 to a desired amount of pressure. As a result, rescue can be accomplished by securing the cuff member 12 onto the limb and then inflating the bladder 14 either from the boat 32 through the gas line 16 or by the activation of the gas canister 18.

Figure 3:
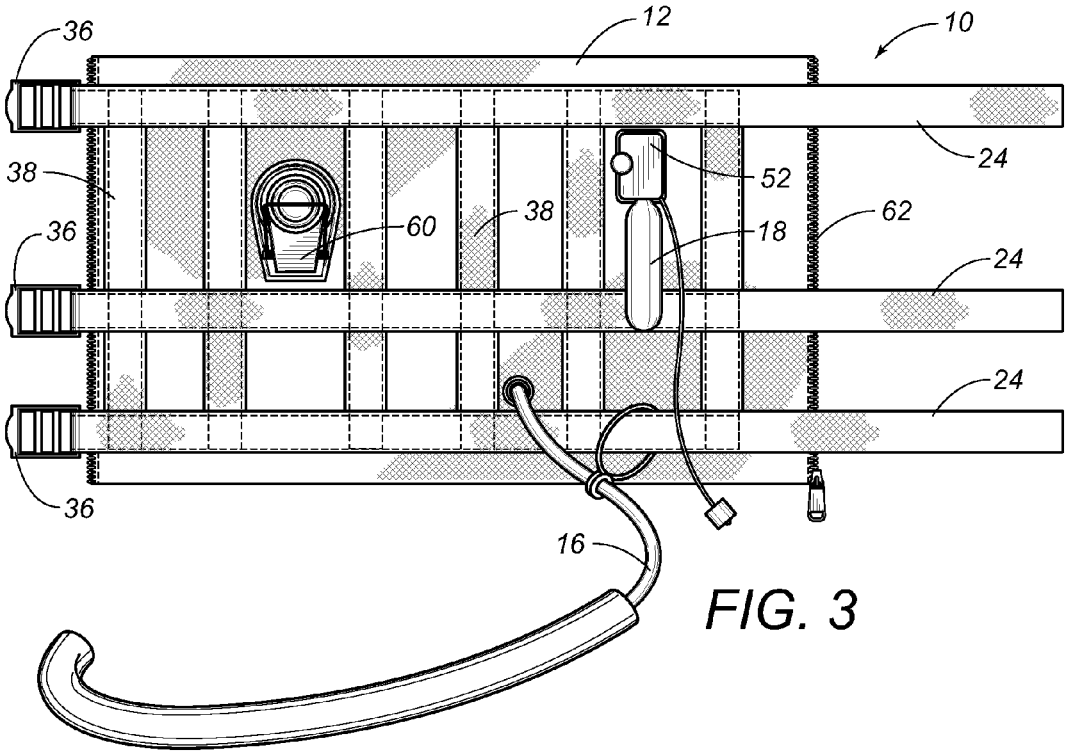
FIG. 3 is a side elevational view of the rescue apparatus of the present invention as fully extended.

FIG. 3 further illustrates the rescue apparatus 10 of the present invention. As can be seen, the plurality of straps 24 are affixed to the exterior surface of the cuff member 12. Straps 24 will extend in generally parallel relationship to each other. Buckles 36 are located at one end of each of the straps 24. Straps 24 can be looped through the buckles 36 so as to provide a mechanism whereby the cuff member 12 can have an adjustable diameter. Gas line 16 is provided so as to extend into the bladder on the other side of the cuff member 12. Gas canister 18 is affixed to the exterior surface of the cuff member 12 by way of valve housing 52. A plurality of web members 38 are also secured to the exterior surface of the cuff member 12 so as to provide strength, rigidity and tear resistance to the material of the cuff member 12.

Importantly, in FIG. 3, it can be seen that a valve 60 is secured to the cuff member 12. Valve 60 allows for the release of air from the bladder 14 in either a manual or automatic manner. For example, if the pressure in the bladder 14 should become too great, then the valve 60 will automatically start to release air from the bladder until a proper pressure is achieved. As a result, injury or damage to the limb 22 is prevented. For example, if too much pressure was introduced into the bladder 14, then circulation to the limb 22 could be damaged. As a result, the valve 60 should be set to a suitable pressure release so as to avoid any inadvertent damage to the human limb. Additionally, the valve 60 includes a lever portion that can be grasped by either the rescuer or the rescuee so as to manually release pressure from the cuff member 14. This facilitates the ability to remove the cuff member 12 subsequent to rescue or under those circumstances whereby the gas line 16 or the cuff member 12 should become entangled with another object. A zipper can be also provided along opposite edges of the cuff member 12 so as to facilitate the assembly of the cuff member 12 into a tubular configuration.

Figure 4:
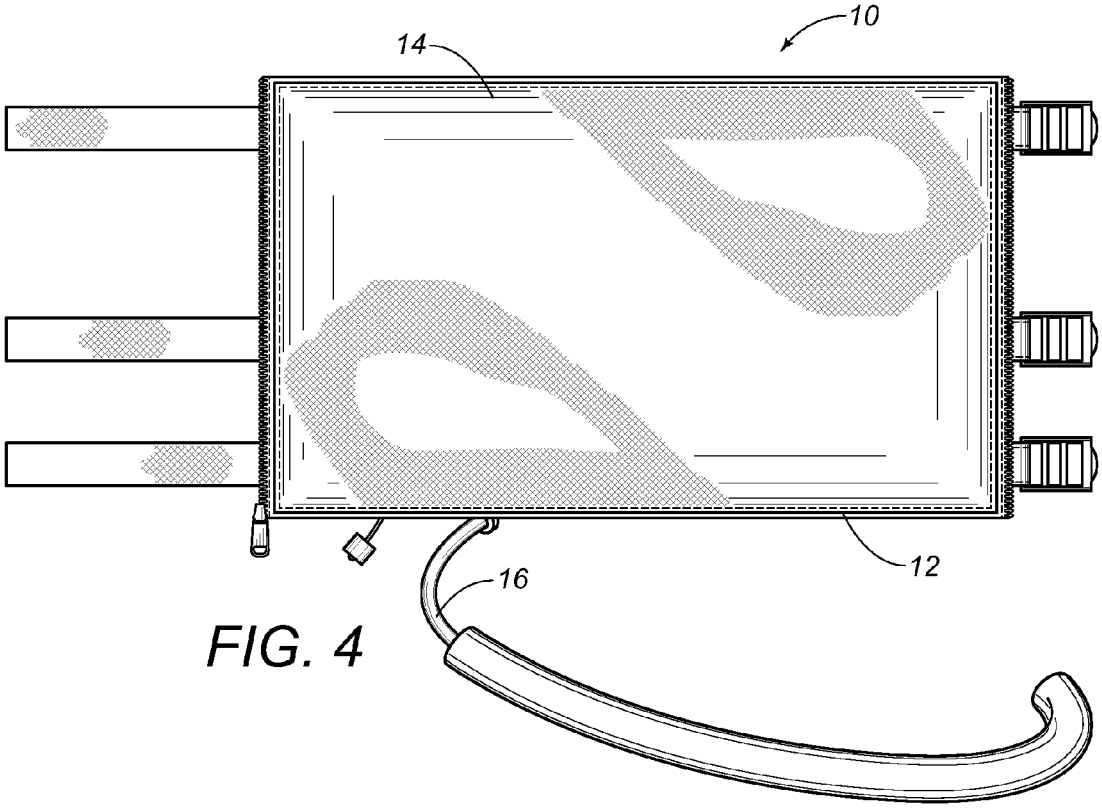
FIG. 4 is an opposite side elevational view of the rescue apparatus of the present invention as fully extended.

FIG. 4 shows the interior of the apparatus 10 of the present invention. It can be seen that the bladder 14 extends across the inner surface of the cuff member 14. The gas line 16 is suitably connected in fluid communication with the bladder 14. The bladder 14 can be formed of a neoprene material, or other suitably air-retentive material, so as to allow the bladder 14 to expand to a desired size when the cuff member 12 is applied onto the human limb.

Figure 5:
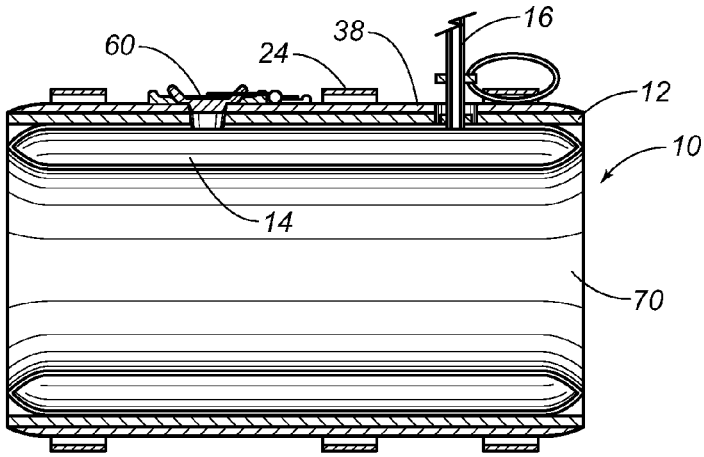
FIG. 5 is a cross-sectioned view of the rescue apparatus of the present.

FIG. 5 illustrates the interior of the rescue apparatus 10 of the present invention. As can be seen, the bladder 14 is illustrated in a slightly expanded manner. Gas line 16 is illustrated as being in fluid communication with the bladder 14. Similarly, the valve 60 is illustrated as also in valved fluid communication with the bladder 14. The bladder 14 is positioned on the interior of cuff member 12. Straps 24 are positioned so as to extend across the cuff member 12. Additionally, the web members 38 are also positioned so as to extend across the cuff member 12. When the bladder 14 is inflated, the inner diameter of the cuff member 12 is suitably reduced for the purpose of placing a compressive force over a relatively wide area onto the surface of a limb extending through the interior 70 of the cuff member 12. As a result, rescue can be effected in the manner described hereinbefore.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A rescue apparatus for application to an arm of a person comprising:

a cuff member having a first end and a second end, said cuff having a longitudinal passageway extending between said first end and said second end, said longitudinal passageway suitable for receiving the arm of the person therein;

a bladder affixed to said cuff member, said bladder being inflatable;

a gas line affixed to a side of said cuff member between said first end and said second end thereof so as to be in fluid communication with said bladder, said gas line extending generally transverse to said longitudinal passageway; and a gas cannister affixed to said cuff member and in valved fluid communication with said bladder, said gas cannister being selectively actuatable so as to introduce a gas into said bladder so as to inflate said bladder.

2. The apparatus of claim 1, said cuff member comprising:

a panel of material having a length suitable for extending around a human limb; and a plurality of straps affixed to said panel and extending thereacross, said plurality of straps for adjustably affixing said panel onto the human limb.

3. The apparatus of claim 2, said bladder extending across one surface of said panel, said plurality of straps extending across an opposite surface of said panel.

4. The apparatus of claim 3, said cuff member further comprising:

a plurality of web members extending across said opposite surface of said panel in a direction transverse to said plurality of straps.

5. The apparatus of claim 1, further comprising:

a rope affixed to and extending along said gas line, said rope having an end affixed to said cuff member.

6. The apparatus of claim 5, said rope comprising:

at least a pair of strands, said gas line being positioned between the pair of strands, the pair of strands and said gas line being covered by a casing material.

7. The apparatus of claim 1, further comprising:

a valve means affixed to said cuff member and in valved relation to said bladder, said valve means for releasing gas from said bladder when the gas pressure in said bladder exceeds a predetermined amount.

8. The apparatus of claim 7, said valve means being manually activatable so as to release gas from said bladder.

9. The apparatus of claim 1, said gas canister having a pull line attached thereto, said pull line for manually activating said gas canister so as to inflate said bladder.

10. The apparatus of claim 1, further comprising:

a gas source connected to an end of said gas line opposite said bladder, said gas source for selectively delivering a gas into said bladder through said gas line from a location remote from said cuff member.

* * * * *